US006265650B1

(12) United States Patent
Arbiter

(10) Patent No.: US 6,265,650 B1
(45) Date of Patent: Jul. 24, 2001

(54) DRUM SHELL

(76) Inventor: Ivor David Arbiter, Melody Lodge, Tenterden Gardens, London NW4 1TG (GB)

( * ) Notice: Subject to any disclaimer, the term of this patent is extended or adjusted under 35 U.S.C. 154(b) by 0 days.

(21) Appl. No.: 09/319,528

(22) PCT Filed: Dec. 5, 1997

(86) PCT No.: PCT/GB97/03378

§ 371 Date: Jul. 29, 1999

§ 102(e) Date: Jul. 29, 1999

(87) PCT Pub. No.: WO98/25259

PCT Pub. Date: Jun. 11, 1998

(30) Foreign Application Priority Data

Dec. 6, 1996 (GB) ..... 9625435

(51) Int. Cl.[7] ..... G10D 13/02
(52) U.S. Cl. ..... 84/411 R; 84/411 A; 84/413
(58) Field of Search ..... 84/411 R, 411 A, 84/413

(56) References Cited

U.S. PATENT DOCUMENTS

| | | | | |
|---|---|---|---|---|
| 1,609,940 | | 12/1926 | Geisler . | |
| 2,485,985 | | 10/1949 | Perry . | |
| 4,079,657 | | 3/1978 | Sobreira . | |
| 4,334,458 | | 6/1982 | Grauso . | |
| 4,483,234 | | 11/1984 | Snavely . | |
| 4,570,526 | * | 2/1986 | Hoshino | 84/413 |
| 4,619,179 | | 10/1986 | Wright . | |
| 4,742,752 | * | 5/1988 | Lubbers | 84/413 |
| 4,754,683 | | 7/1988 | Townsend et al. . | |
| 4,832,334 | * | 5/1989 | Snavely | 84/269 |
| 5,157,212 | | 10/1992 | Fleming . | |
| 5,261,309 | * | 11/1993 | Valen | 84/453 |
| 5,309,810 | | 5/1994 | May . | |
| 5,517,890 | * | 5/1996 | Cooperman | 84/411 R |
| 5,544,561 | * | 8/1996 | Isomi | 84/421 |
| 5,587,544 | | 12/1996 | Fujii et al. . | |
| 5,675,099 | * | 10/1997 | Granatello | 84/411 R |
| 6,043,419 | * | 3/2000 | Aribiter | 84/411 R |

FOREIGN PATENT DOCUMENTS

| | | |
|---|---|---|
| 95 131 | 1/1897 | (DE) . |
| 566816 | 3/1932 | (DE) . |
| 629 075 | 4/1936 | (DE) . |
| 919082 | 10/1954 | (DE) . |
| 1073282 | 1/1960 | (DE) . |
| 1120851 | 12/1961 | (DE) . |
| 613316 | 6/1946 | (GB) . |
| 1 488 167 | 10/1977 | (GB) . |
| 1 558 045 | 12/1979 | (GB) . |
| 2 302 200 | 1/1997 | (GB) . |

* cited by examiner

*Primary Examiner*—Jeffrey Donels
*Assistant Examiner*—Kim Lockett
(74) *Attorney, Agent, or Firm*—Patterson, Thuente, Skaar & Christensen, P.A.

(57) ABSTRACT

A drum comprising a drum shell (11) formed with a circumferential channel (17) in its external surface; a shell hoop (15) located in the channel (17); and at least one fixing member (16), in which the shell hoop (15) has a radially outwardly inclined portion (26) arranged to engage a clamp ring (31), and the fixing member (16) includes means for attaching drum fittings, the fixing means (16) being fixed relative to the shell hoop (15).

14 Claims, 4 Drawing Sheets

15
17
47
56
59
11

15
17
26
47
46
48
11

15
26
23
29
27
11
17
22
25
16
24
28

DRUM SHELL

The present invention relates to drums, that is to say percussion instruments, such as snare drums, tom-toms, bass drums, tympani, and the like. The invention is particularly concerned with the attachment of fittings to drum shells.

In conventional drums, the skin of the drum head is stretched over the open end of a cylindrical drum shell and is held in position by means of a counter-hoop which bears on the rim of the head. The skin is tensioned by means of tensioning bolts which act on the counter-hoop and engage tapped fittings fixed to the drum shell. When these bolts are tightened, the counter-hoop is urged against the rim, thus tensioning the skin. These tapped fittings are fixed to the shell by bolts which pass through the drum shell. Other fittings, such as snare fittings for snare drums, legs for floor tom toms, bass drum spurs, and hanging tom-tom fixings (both on the tom toms and the bass drum) are also attached to the respective drum shells by bolts passing through the respective drum shells.

Currently, there is a view, particularly amongst drummers, that the sound made by a drum is adversely affected if the integrity of the shell is compromised. Thus, by drilling holes through conventional drum shells, to attach the various fittings, the drum sound is less than optimum.

It is therefore an object of the invention to provide a drum design in which the fittings can be attached without drilling holes in the shell.

To an extent, this is achieved in the designs shown in the present Applicants' co-pending: British Patent Application No. 9617963.5. This is directed to a drum comprising: a drum shell, a drum head having a skin extending over an open end of the shell and a circumferential hoop lying outside the open end of the shell; a counter-hoop lying over the head hoop; and a shell ring attached to and surrounding the shell in the vicinity of the open end. The counter-hoop and the shell hoop each have a radially outwardly extending portion, the outwardly extending portions being such that the counter-hoop portion is inclined downwards and/or the shell hoop portion is inclined upwards. The drum also includes a clamp ring which surrounds the drum shell and engages the two outwardly extending portions, the clamp ring being capable of radial expansion and contraction. Thus, as the clamp ring contracts, it exerts an inward compression force which tends to draw the counter-hoop towards the shell hoop which tensions the drum skin.

In this design, the fittings for attaching and tuning the drum head are attached to the drum shell without having to drill holes in the shell. However, other fittings such as snare fittings, tom-tom attachment fittings and leg fittings still require drilled holes in the shell.

According to the invention, there is provided a drum shell formed with a circumferential channel in its external surface, a shell hoop located in the channel and at least one fixing member; in which the shell hoop has a radially outwardly inclined portion arranged to engage a clamp ring, and the fixing member includes means for attaching drum fittings, the fixing means being fixed relative to the: shell hoop.

Preferably the fixing member is of stainless steel and comprises first and second flat portions joined by an inclined intermediate portion. The first portion may be located within the channel while the intermediate portion extends out of the channel and the second portion may lie against the outside surface of the shell.

The means for attaching fittings may be constituted by bolts extending outwards from the second portion of the fixing member. A fitting can then be located on the bolt and fixed in position by a nut, such as a wing-nut. However, any other convenient means for attaching fittings can be employed.

The fixing member may be located in the channel, preferably underlying the shell hoop and attached to the shell hoop by bolts, adhesive or welding. Alternatively, the fixing member may simply be located in the channel and gripped by the shell hoop. Preferably, the fixing member has a portion extending out of the channel.

In a preferred form, the fixing member may be outside the channel and welded to the shell hoop. It may include a portion which is spaced from the drum shell, with means such as holes or bolts for the attachment of fittings. There may be a support pad between the spaced portion and the shell. Preferably, however, the fixing member lies adjacent the drum shell.

There are preferably several fixing members located as required about the periphery of the drum. The fixing members are preferably located at both drum heads. The fixing members may be relatively long and may be located relative to a shell hoop at both ends of the drum.

In a preferred embodiment., the invention can be considered to provide a drum comprising: a drum shell having a circumferential channel in its outer surface, a drum head having a skin extending over an open end of the shell and a circumferential hoop lying outside the open end of the shell; a counter-hoop lying over the head hoop; and a shell hoop located within the channel in the vicinity of the open end; the counter-hoop and the shell hoop each having a radially outwardly extending portion, the outwardly extending portions being such that the counter-hoop portion is inclined downwards and/or the shell hoop portion is inclined upwards; the drum also including a clamp ring which surrounds the drum shell and engages the two outwardly extending portions, the clamp ring being capable of radial expansion and contraction; the drum also including a fixing member including means for attaching drum fittings, the fixing member being fixed relative to the shell hoop, preferably by welding. The fixing member preferably includes the means for attaching drum fittings.

Thus, as the clamp ring contracts, it exerts an inward compression force which tends to draw the counter-hoop towards the shell hoop which tensions the drum skin.

The counter-hoop bears directly on the head hoop. However, optionally, a compression ring may be located between the counter-hoop and the head hoop. The location of the shell hoop can be achieved with considerable accuracy, thus minimising the likelihood of uneven forces being applied to the head hoop by the counter-hoop.

The outwardly extending-portion of the counter-hoop is preferably a continuous flange. The shell hoop may be discontinuous and may even be constituted by circumferentially spaced blocks or bosses, however, the shell hoop is preferably a continuous ring and the outwardly extending portion is preferably a continuous flange. The shell hoop is let into the channel formed in the shell, preferably overlying the fixing member. An outer clamp ring (such as a hose-clip) may be used additionally to hold the shell hoop in place.

Preferably, the counter-hoop is of stainless steel which is preferably polished. The compression ring (if included) may be of any suitable deformable material and is preferably also resilient; a convenient material is NEOPRENE™.

The clamp ring is preferably made of a strong non-elastic but resilient material such as steel. It preferably includes radially inwardly extending rails which are inclined in a way which corresponds to any inclination of the outwardly extending portions of the counter-hoop and shell hoop. Preferably, the inclinations are symmetrical.

The clamp ring may be radially contractible by reducing its circumferential length. This may be achieved by the clamp ring being in the form of a breached circular band with two ends; by moving the ends relative to each other circumferentially, the effective circumference of the clamp ring can be varied. In order to control this adjustment, the clamp ring may have a screw thread arrangement spanning the breach. Preferably a first end of the clamp ring on one side of the breach has an internally threaded member, while the second end of the clamp ring on the other side of the breach has a bush. A bolt may then pass through the bush and into the threaded member, so that as the bolt is rotated, it is drawn through the threaded member and the bolt head will bear against the bush. Continued rotation will move the bush towards the threaded member and so tighten the clamp ring.

Preferably, the clamp ring is hinged in a position remote from the breach, conveniently at a position opposite the breach. This arrangement will allow the clamp ring to be fitted in position more readily.

The construction and arrangement of the clamp ring is described in detail in GB 9617963.5 mentioned above.

The invention may also be particularly applicable to tympani and drums played by the hands. The counter-hoop could be reduced in height in order that it should not protrude above the level of the drum skin.

The invention may be carried into practice in various ways and one embodiment will now be described by way of example with reference to the accompanying drawings, in which.

Figure 2:
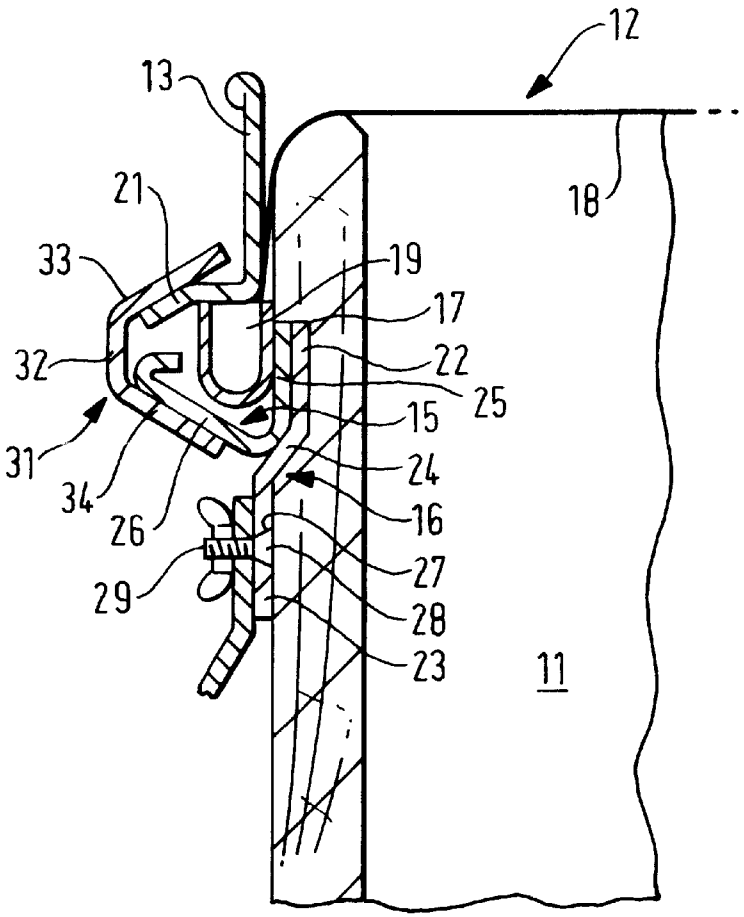
FIG. 2 is a view similar to FIG. 1 showing the drum head tensioned.
Figure 1:
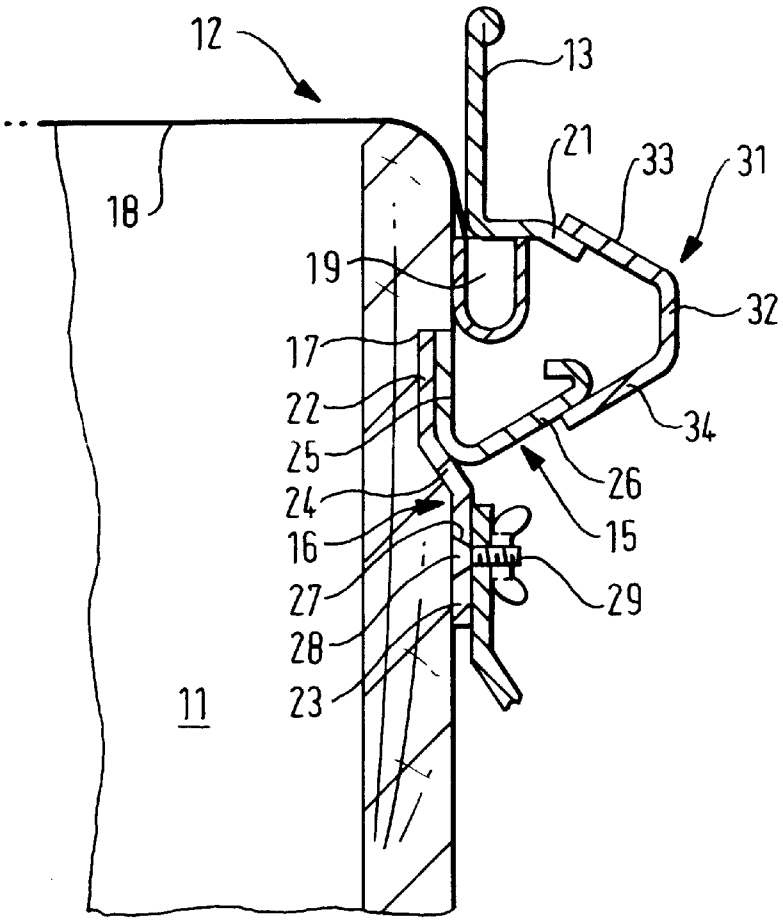
FIG. 1 is a partial vertical section through one wall of a drum in accordance with the present invention.

As shown in FIGS. 1 and 2, the drum comprises a drum shell 1l, a drum head 12, a counter-hoop 13, a shell hoop 15 and a series of fixing members 16, only one of which is shown. The drum shell 11 is of standard laminated resin bonded hardwood construction. It is cylindrical and open ended and is formed with a circumferential channel 17 in its outer surface. The shell hoop 15 and fixing members 16 are of polished stainless steel.

The head 12 comprises a skin 18 and a flesh hoop or bead 19 at its periphery. The bead 19 is located outside the drum shell 11 so that the skin 18 stretches over the open end. The counter-hoop 13 is of polished stainless steel and has a downwardly and outwardly extending flange 21. The flange 21 of the counter-hoop 13 bears on the bead 19.

The fixing member 16 comprises a first flat portion 22 and a second flat portion 23 joined together by an inclined intermediate portion 24. The shell hoop 15 comprises a vertical upwardly extending skirt 25 and an upwardly and outwardly inclined rim 26. The inclined rim 26 is turned inwards at its outer periphery.

The first portion 22 of the fixing ring is located in the channel 17 where it may be fixed with a suitable adhesive though this may not be necessary. The second portion 23 fits snugly against the drum shell 11. The second portion 23 is formed with countersunk holes 27 in which bolts 28 are located so that the threaded shanks 29 protrude radially outwards. The bolts are kept in position by the drum shell 11.

The skirt 25 of the shell hoop 15 is also located in the channel 17 and overlies the first portion 22 of the fixing rings 16.

The counter-hoop 13 is held in position by a clamp ring 31. The clamp ring 31 is a steel band with overlapping ends, and a C-shaped cross-section comprising a generally flat spine 32 with upper and lower skirts 33,34. The skirts 33,34 extend inwardly and diverge with inclinations corresponding to those of the rim 26 and flange 21. Thus, when in position, the upper skirt 33 fits over the flange 21 on the counter-hoop 13 and the lower skirt 34 fits beneath the shell hoop rim 26.

As the clamp ring 31 is constricted, the skirts 33,34 engage the flange 21 and rim 26, so locating the counter-hoop 13. As the clamp ring 31 is tightened further, the counter-hoop 13 is drawn down by the dual camming action of the two skirts 33,34, to the position shown in FIG. 2. This in turn exerts a downward pressure on the bead 19 which stretches the skin 18 evenly over the rim of the shell 11.

Fittings are attached to the drum by means of the bolts 28. A fitting, schematically shown at 35, is formed with a through hole 36 which is located over the bolt shank 29. A wing-nut 37 is then tightened on the shank 29 to fix the fitting 35 in position. The fitting might be a tom-tom mounting plate.

It will be appreciated that there would generally be a similar arrangement to that illustrated, at the other end of the drum, that is to say at the bottom. The components would then be the opposite way up. Thus, where the fittings to be attached were legs, they would be located by means of fixing members at the bottom. A snare support fitting might also be located by means of lower fixings-members.

Figure 4:
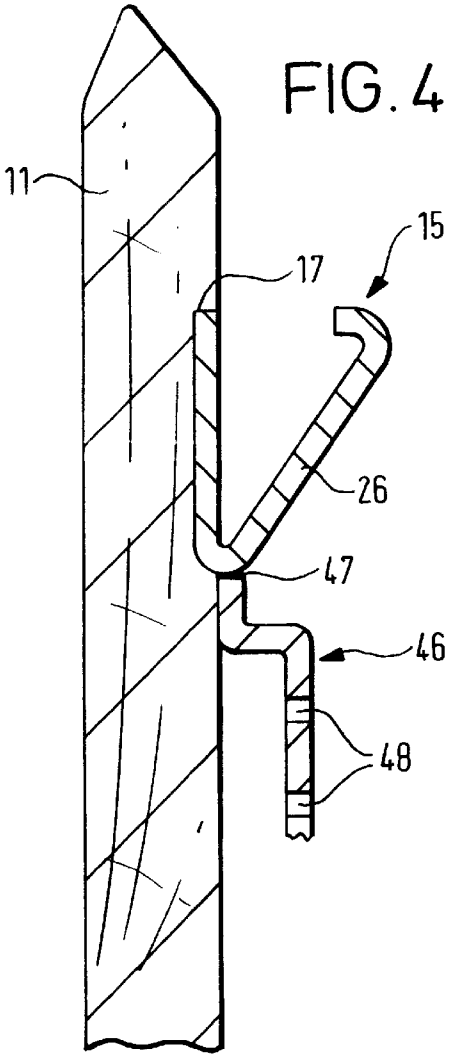

In the embodiment shown in FIG. 4, the fixing members 46 are not located in the channel 17 but are welded to the shell hoop 15 at 47. Two bolt or screw holes 48 are provided in the fixing member 46 for attachment of the appropriate fitting. In the embodiment shown, the fixing member 46 extends down to the other end of the drum shell 11 and is welded to the shell hoop at the other end (not shown) in a similar fashion. This could also be the case in modified forms of the other illustrated embodiments.

Figure 5:
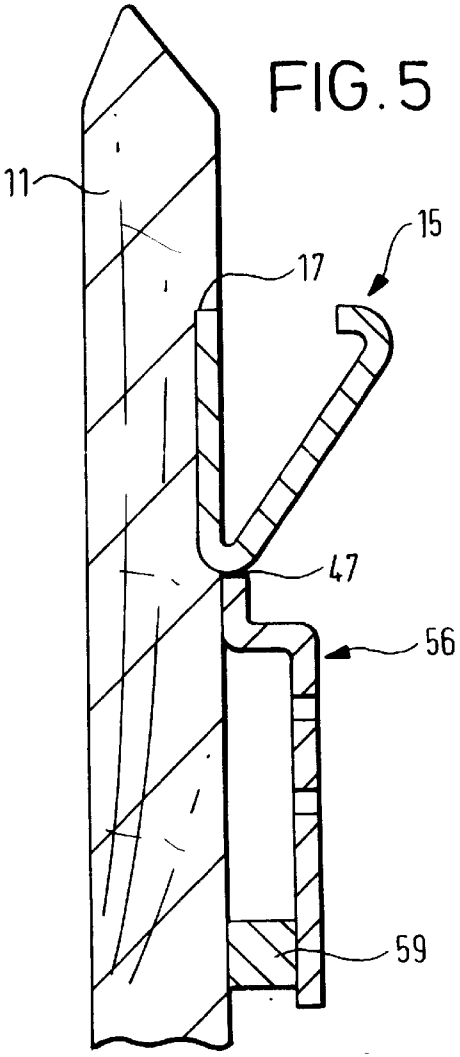
FIGS. 4 and 5 are views similar to FIG. 3 showing two alternative embodiments.

In the embodiment shown in FIG. 5 the fixing member 56 is again welded to the shell hoop 15. In this case a spacer 59 supports the distal end of the fixing member 56.

Figure 6:
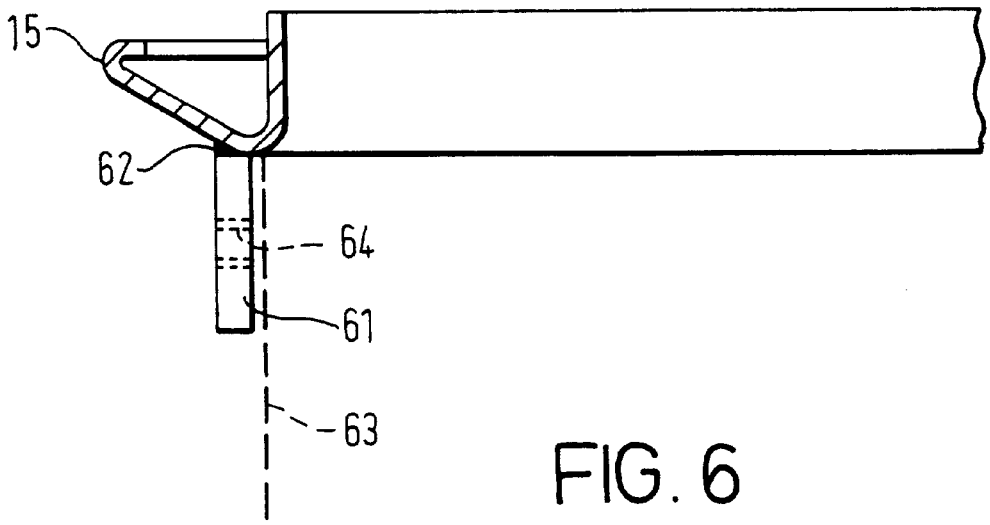
FIG. 6 shows a preferred form of fixing member for a snare drum.

FIG. 6 shows a preferred embodiment in which only the fixing member 61 and the shell hoop 15 are shown, for clarity. The fixing member 61 is welded, to the shell hoop 15 at 62. The fixing member 61 is relatively short and lies flat against the drum shell whose position is indicated by the broken line 63. The fixing member 61 has two holes 64 for locating a snare drum fitting. With such an arrangement, there would be a corresponding fixing member welded to the respective shell hoop at the other end of the drum.

Figure 3:
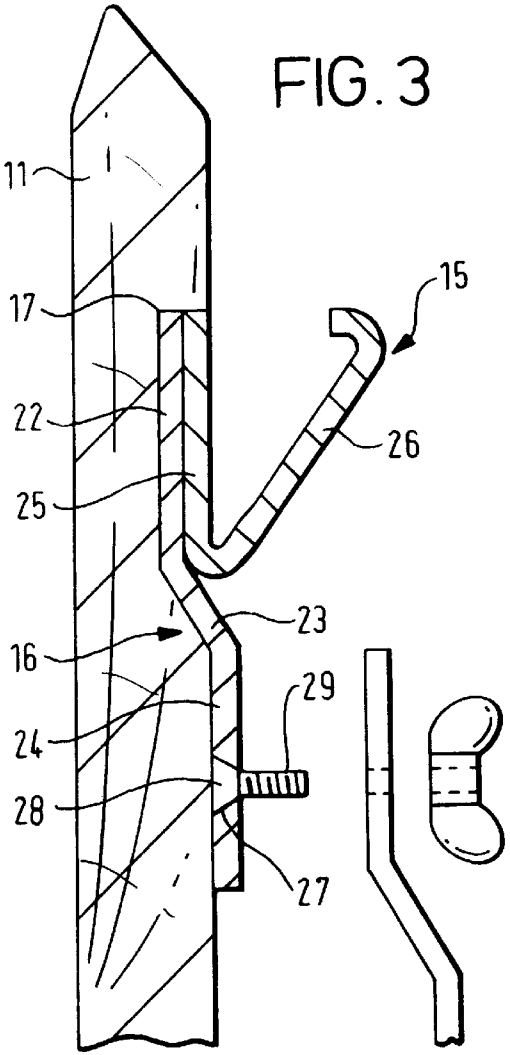
FIG. 3 is a simplified sectional view to an enlarged scale showing a fitting to be attached to the fixing ring.
Figure 7:
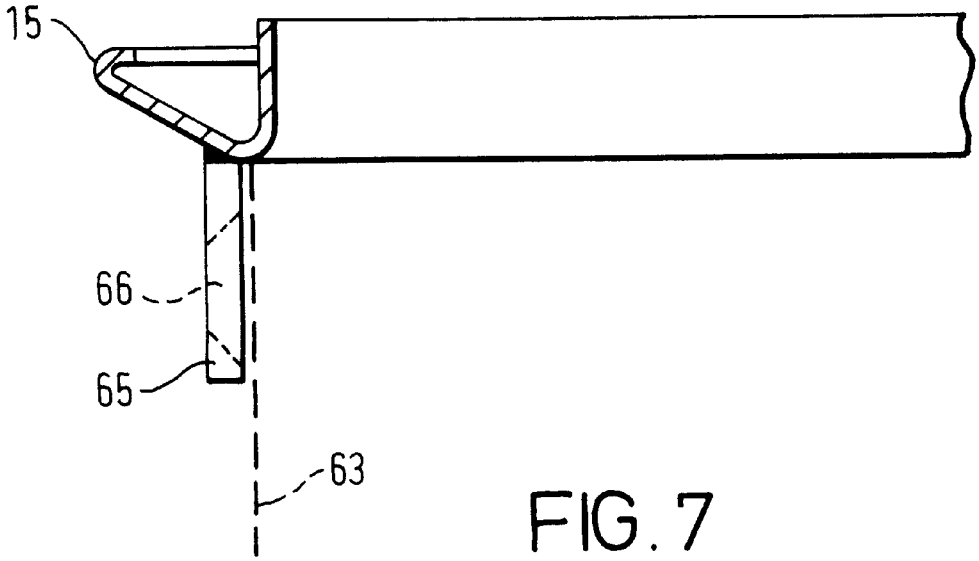
FIG. 7 shows a preferred form of fixing member for a tom tom.

FIG. 7 is similar to FIG. 6 except that it shows a fixing member 65 for a tom tom. The fixing member 65 has a single countersunk hole 66 for a bolt (not shown) similar to the bolts 28 in FIG. 3, which can be used to attach fittings by means of which the drum can be mounted. This embodiment is therefore suitable for tom toms, bass drums etc.

Figure 8:
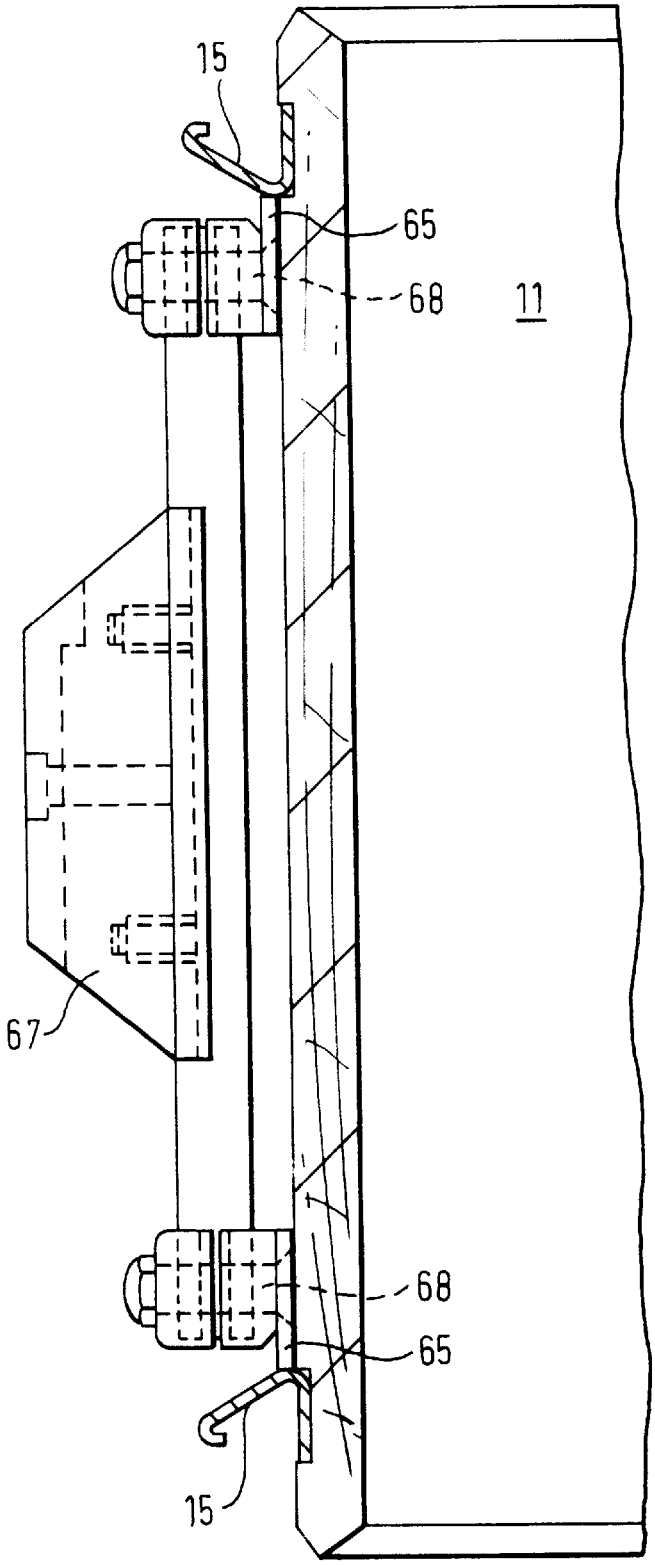
FIG. 8 is a section through a tom tom shell showing a fitting attached using the fixing members of FIG. 7.

As shown in FIG. 8, the drum 11 is provided with two corresponding fixing members 65 welded to respective shell hoops 15 at each end of the drum 11. The fitting 67 is attached To both fixing members 65 by means of bolts 68.

In an alternative embodiment (not shown), the fixing members may be entirely located within the channel 17. However, the fixing members may each have an inwardly stepped outer surface which receives the shell hoop 15. The bolts 28 would then bear against the base of the channel 17. In a further variant (not shown), the fixing members and shell hoop may be of unitary construction.

What is claimed is:

1. A drum comprising a drum shell having an external surface; a circumferential channel formed in said external surface; a shell hoop located in said channel; a clamp ring; and at least one fixing member; wherein said shell hoop has a radially outwardly inclined portion arranged to engage said clamp ring, and said fixing member includes means for attaching drum fittings, said fixing means being fixed relative to said shell hoop.

2. A drum according to claim 1, wherein said fixing member is located outside said channel and is welded to said shell hoop.

3. A drum according to claim 1, wherein said fixing member comprises first and second flat portions and an inclined intermediate portion interconnecting said first and second flat portions, said first portion being located within said channel while said intermediate portion extends out of said channel and said second portion lies against said external surface of said shell.

4. A drum according to claim 1, wherein said fixing member includes holes and/or bolts for the attachment of fittings.

5. A drum according to claim 1, including several said fixing members, located at both ends of said drum.

6. A drum comprising: a drum shell having an outer surface and an open end and having a circumferential channel in said outer surface; a drum head comprising a skin extending over said open end of said shell and a circumferential head hoop lying outside said open end of said shell; a counter-hoop lying over said head hoop; and a shell hoop located within said channel in the vicinity of said open end; said counter-hoop and said shell hoop each having a radially outwardly extending portion, said outwardly extending portions being such that said outwardly extending portion on said counter-hoop is inclined downwards and/or said outwardly extending portion on said shell hoop is inclined upwards; said drum also including a clamp ring which surrounds said drum shell and engages said two outwardly extending portions, said clamp ring being capable of radial expansion and contraction; said drum also including a fixing member fixed relative to said shell hoop.

7. A drum according to claim 6, wherein said fixing member and said counter-hoop are of stainless steel.

8. A drum according to claim 6, wherein said outwardly extending portion of said counter-hoop is a continuous flange and said outwardly extending portion of said shell hoop is a continuous flange.

9. A drum according to claim 6, wherein said clamp ring is made from a strong non-elastic but resilient material.

10. A drum according to claim 6, wherein said clamp ring is radially contractable by reducing its circumferential length.

11. A drum according to claim 6, wherein said clamp ring is in the form of a breached circular band with two ends and with a screw thread arrangement spanning the breach.

12. A drum according to claim 11, wherein said clamp ring is hinged in a position remote from said breach.

13. A drum according to claim 1, wherein said fixing member includes bolts for the attachment of fittings.

14. A drum according to claim 1, wherein said fixing member includes holes and bolts for the attachment of fittings.

* * * * *